United States Patent [19]

Quine

[11] 4,328,471

[45] May 4, 1982

[54] BANDWIDTH COMPENSATED QUARTER-WAVE COUPLED POWER COMBINER

[75] Inventor: John P. Quine, Colonie, N.Y.

[73] Assignee: General Electric Company, Schenectady, N.Y.

[21] Appl. No.: 187,469

[22] Filed: Sep. 15, 1980

[51] Int. Cl.[3] ..... H01P 5/16

[52] U.S. Cl. ..... 333/128; 333/246

[58] Field of Search ..... 333/127, 128, 136

[56] References Cited

U.S. PATENT DOCUMENTS 4,129,839 12/1978 Galani et al. ..... 333/128

4,234,854 11/1980 Schellenberg et al. ..... 330/295 X

OTHER PUBLICATIONS

Lange, Jr. et al., *A Y to Δ Transformation of a Three--Way Hybrid Junction,* IEEE Trans. on MTT, Oct. 1969, pp. 789–790.

Cohn et al., *A 10 Watt Broadband FET Combiner/Amplifier,* 1979 IEEE MTT-S Symposium Digest, pp. 292–297.

Quine et al., *MIC Power Combiners for FET Amplifiers,* Proc. of Ninth European Conf., Brighton, Eng., Sep. 17–20, 1979, pp. 66–664.

*Primary Examiner*—Paul L. Gensler

*Attorney, Agent, or Firm*—Donald R. Campbell; James C. Davis, Jr.; Marvin Snyder

[57] ABSTRACT

A microwave power combiner/divider is matched internally and has increased bandwidth. A microwave integrated circuit disk within the housing has high impedance radially directed quarter-wavelength lines to obtain an impedance match for the desired mode at the centered coaxial port. Bridging half-wavelength lines between adjacent peripheral ports match the undesired mode and connect to absorbing resistors; these lines also provide bandwidth compensation. The housing has an annular shield with an opening near the centered coaxial line to provide a high choke impedance.

2 Claims, 3 Drawing Figures

BANDWIDTH COMPENSATED QUARTER-WAVE COUPLED POWER COMBINER

BACKGROUND OF THE INVENTION

This invention relates to microwave power combiners/dividers and especially to a microwave integrated circuit combiner which has broad frequency characteristics.

MIC power combiners comprising a radial waveguide with a coxial port at the center and N microstrip ports on the periphery have been described by M. Cohn et al., "A 10 Watt Broadband FET Combiner/Amplifier", 1979 IEEE MTT-S Symposium Digest, pp. 292–297. These earlier configurations are matched externally in the coaxial port. A three-way power divider/summer in the Wilkinson configuration was fabricated in stripline by replacing the Y resistive balancing network by a delta resistive network. A modification shows half-wave lines connecting absorber resistors to the output ports of a three-way combiner. The same impedance was chosen for both the balancing resistor transmission lines and the quarter-wave matching sections. See FIG. 2 of the article by J. Lange, Jr. and B. Rose, IEEE Transactions on Microwave Theory and Techniques, Vol. MTT-17, No. 10, October 1969, pp. 789–790. This invention is an improvement over the foregoing and similar prior art.

SUMMARY OF THE INVENTION

This matched microwave integrated circuit (MIC) power combiner or divider has broad frequency characteristics. The metal housing of the illustrative embodiment has equally spaced peripheral ports and a centered coaxial transmission line. A MIC disk within the housing couples energy between every peripheral port and the coaxial port. The metallization pattern includes two or more outer radial microstrip lines with a given characteristic impedance such as 50 ohms; and inner radial high impedance, quarter-wavelength microstrip lines each connected to an outer line and providing an impedance match for the desired mode in which the energy has zero phase difference at adjacent peripheral ports. Half-wavelength lines bridge across the outer ends of adjacent pairs of quarter-wavelength lines and connect to resistors for absorbing undesired mode power. These half-wavelength lines preferably have an impedance equal to at least twice the outer radial line impedance and provide a match for the undesired mode, in which the energy has a 180° phase difference at adjacent peripheral ports; they also provide bandwidth compensation for the desired mode.

A shield extends inwardly from the circular side wall of the housing and divides the space above the disk into two chambers, the uppermost of which has a radius of one quarter-wavelength at midband and provides a high choke impedance. Coax connectors may be inserted at the peripheral ports for leads to field effect transistor (FET) amplifiers. There is a significant improvement in bandwidth of the combined power at the center coaxial line. One application is a solid state traveling-wave tube (TWT) replacement.

DESCRIPTION OF THE PREFERRED EMBODIMENT

Figure 1:
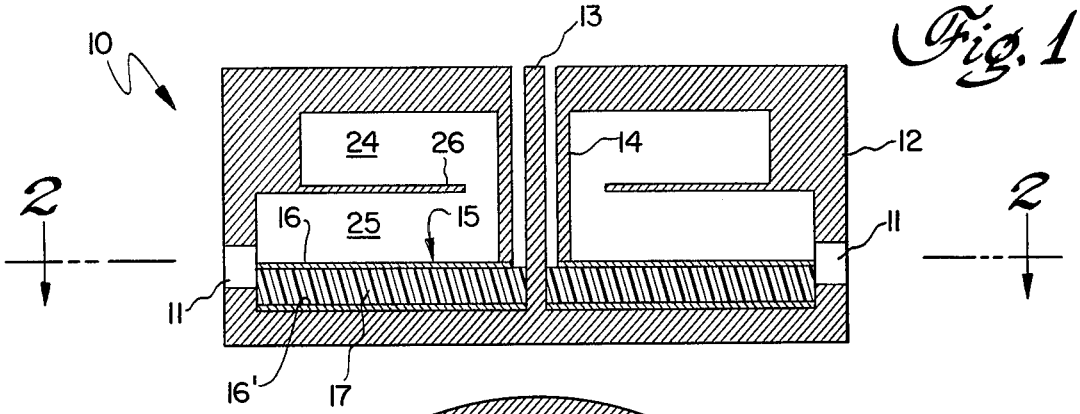
FIG. 1 is a vertical cross section through the housing and microwave integrated circuit disk showing the internal configuration of the combiner.
Figure 2:
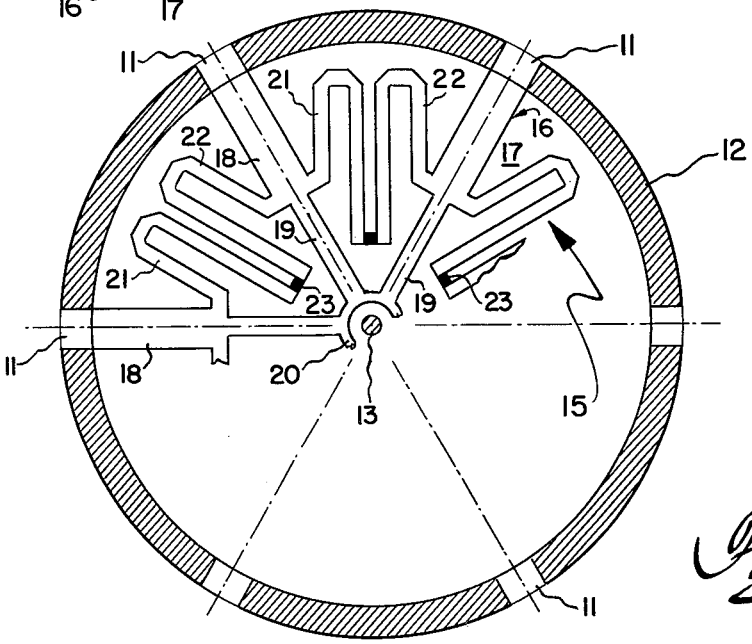
FIG. 2 is a plan view of the MIC combiner disk and a horizontal section through the housing.

The six-way MIC power combiner in FIGS. 1 and 2 has a generally cylindrical metal housing 10 and six radially extending holes 11, which are the peripheral ports, in the circular side wall 12. The bottom housing wall is continuous and has at its center an upstanding coaxial transmission line center conductor 13. The concentric sheath 14 of the coaxial line depends from the top housing wall which is continuous except for a hole in the center which receives a coaxial connector. Coax connectors may also be inserted into radial holes 11, and are connected by leads to field effect transistors or other solid state amplifiers.

A flat MIC combiner disk 15 is retained within the housing and contacts the bottom end of the sheath 14 of the centered coaxial line. The metallization pattern 16 on the top surface of dielectric substrate 17 is illustrated in detail in FIG. 2; the bottom surface has a continuous metallization 16' and is the ground plane. Six outer radially directed microstrip lines 18, at a 60° spacing, have a given characteristic impedance, $Z_o$, such as 50 ohms. These output lines 18 couple to microwave energy propagating through peripheral ports 11. Six high impedance quarter-wavelength microstrip lines 19 are connected between the outer lines 18 and a central ring 20, and lines 19 are approximately one quarter wavelength long at the known center frequency. These are $\lambda/4$ matching transformers and provide an impedance match for the desired mode in which the power at all the peripheral ports is in phase.

A pair of half-wavelength bridging microstrip lines 21 and 22 are connected to the outer ends of adjacent quarter-wavelength lines 19 and, at the center, to a planar power absorbing resistor 23. These folded $\lambda/2$ bridging lines fit within a minimum space and provide an impedance match for the undesired mode in which there is a 180° phase diffference between adjacent peripheral ports. Lines 21 and 22 also provide bandwidth compensation for the desired mode. The length of output lines 18 is unspecified but are as short as possible. In the assembly, the central ring 20 contacts the bottom end of coaxial line sheath 14.

Microwave power in the desired modes which is in phase at peripheral ports 11 is transmitted by lines 18 and 19 to the center coaxial line 13, 14. Quarter-wavelength lines 19 provide an impedance match at the centered coaxial port. Half-wavelength lines 21 and 22 shunt across adjacent pairs of $Z_o$ peripheral ports to connect resistors 23 for absorbing power in higher order combiner modes. In a compensated quarter-wave coupled MIC combiner for 7.5 GHz, a value for resistor 23 of 200 ohms results in a match for the highest order combiner mode which has 180° phase difference between adjacent peripheral ports. These resistors 23 have no effect on the desired mode which has zero phase difference. The susceptance of shunt lines 21 and 22 at the peripheral ports is zero at midband and compensates for the susceptance of quarter-wave lines off midband.

The space within the housing 10 above MIC disk 15 is divided into two chambers 24 and 25 by a thin annular shield 26 that extends inwardly from the circular side wall 12 of the housing, and provide two impedances in series. The choke opening is placed near coaxial line output conductor 14. The radius of upper chamber 24 is approximately one quarter wavelength and provides a high choke impedance; the performance is then independent of the diameter of the lower chamber. The output choke system decouples the input connector at peripheral port 11 from the lower chamber 25 and realizes a reliable combiner.

Figure 3:
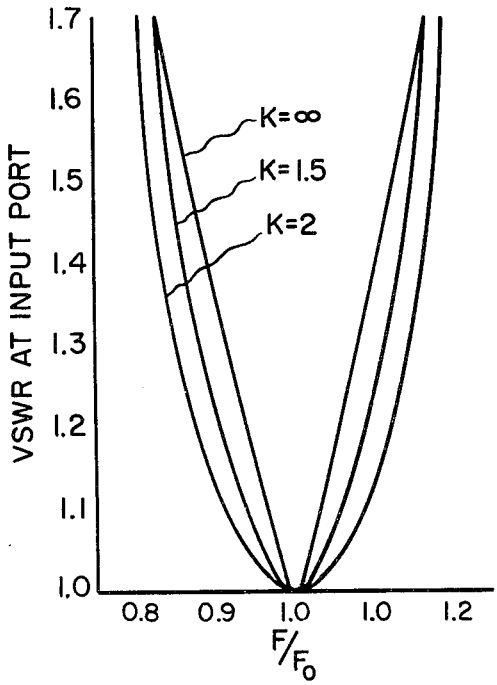
FIG. 3 is a plot of VSWR vs. $F/F_o$ for different half-wavelength bridging line impedances.

The compensation in bandwidth is seen in FIG. 3, and demonstrates that this combiner configuration yields a significant improvement in bandwidth. The ordinate in this graph is voltage standing wave ratio at the input port (port 11) and the abscissa is the ratio $F/F_o$, where $F_o$ is the center frequency. The curves are for different values of K, where $KZ_o$ is the impedance of half-wavelength bridging lines 21 and 22. The bandwidth compensation is best at $K=2$. Assuming that $F_o=7.5$ GHz, the zero transmission frequencies at about 6.2 and 8.8 GHz are symmetrically located about the center frequency and result from series resonance of upper and lower chambers 24 and 25.

A quarter-wave coupled combiner that was built and operated successfully had the following dimensions. The diameter of MIC disk 15, which had a quartz substrate, was 1 inch and the maximum diameter at the fold in half-wavelength lines 21 and 22 was 0.9 inch. Microstrip lines 18 had a width of 0.083 inch and an impedance of 50 ohms; quarter-wavelength lines 19 had a width of 0.0105 inch and an impedance of 125.3 ohms; half-wavelength lines 21 and 22 had a width of 0.040 inch and an impedance of 100 ohms; and power absorbing resistor 23 was 200 ohms. The height of the excitation gap below MIC metallization 16 was 0.039 inch; the height of chamber 25 between disk 15 and shield 26 was 0.80 inch; and the height of the top wall of upper chamber 24 from disk 15 was 0.200 inch. This was a 7.5 GHz combiner, and bandwidth for reflection of −20 dB was about 500 MHz. Broader bandwidths are expected with optimization.

Alternatively, the structure is a power divider, and in this case input microwave power at the center coaxial port divides equally among the peripheral ports. The series power absorbing resistors 23 can be readily replaced with radial slots filled with absorber in the ground plane to obtain very high power capability. Another modification is that the FET amplifier modules can be on the MIC substrate. One application of the combiner is a solid state traveling-wave tube (TWT) replacement.

For further information, see "MIC Power Combiners for FET Amplifiers", J. P. Quine, J. G. McMullen, and H. W. Prather, Proceedings of the Ninth European Microwave Conference, Brighton, England, Sept. 17–20, 1979, pages 661–664, the disclosure of which is incorporated herein by reference.

While the invention has been particularly shown and described with reference to a preferred embodiment thereof, it will be understood by those skilled in the art that the foregoing and other changes in form and details may be made therein without departing from the spirit and scope of the invention.

The invention claimed is:

1. An improved microwave power combiner/divider comprising:

a metal housing having at its center a coaxial transmission line comprised of a grounded center conductor and a cylindrical shield, and having a circular side wall with equally spaced holes that are peripheral ports;

a planar microwave integrated circuit disk retained within said housing which couples microwave energy between every peripheral port and said coaxial line;

said disk having a dielectric substrate and a metallization pattern including outer radial microstrip lines with a given characteristic impedance; an inner approximately quarter-wavelength radial microstrip line which is connected to every such outer line and provides an impedance match for the desired mode having zero phase difference between adjacent peripheral ports; and a pair of half-wavelength microstrip lines bridging the ends of every adjacent pair of quarter-wavelength lines and connecting to resistance means for absorbing undesired mode power which has a 180° phase difference at adjacent peripheral ports, said half-wavelength lines providing an impedance match for the undesired mode and bandwidth compensation for the desired mode; the aforesaid quarter and half wavelengths being a midband; and an annular shield extending inwardly from the side wall of said housing and dividing the space above said disk into two chambers which are a choke system.

2. The combiner/divider of claim 1 wherein the upper chamber has a radius of about one quarter wavelength and provides a high choke impedance, making performance independent of the diameter of the lower chamber.

* * * * *

UNITED STATES PATENT AND TRADEMARK OFFICE

CERTIFICATE OF CORRECTION

PATENT NO. : 4,328,471

DATED : May 4, 1982

INVENTOR(S) : John Peter Quine

It is certified that error appears in the above—identified patent and that said Letters Patent is hereby corrected as shown below:

Claim 1, line 41, "a midband" should read -- at midband --

Signed and Sealed this

*Seventeenth* Day of *August 1982*

[SEAL]

*Attest:*

GERALD J. MOSSINGHOFF

*Attesting Officer*

*Commissioner of Patents and Trademarks*